US007434427B1

(12) United States Patent
Miresmaili

(10) Patent No.: US 7,434,427 B1
(45) Date of Patent: Oct. 14, 2008

(54) GUN VAULT WITH POP-UP HOLSTER

(76) Inventor: Masoud S. Miresmaili, 601 E. Juanita Ave., San Dimas, CA (US) 91773

( * ) Notice: Subject to any disclaimer, the term of this patent is extended or adjusted under 35 U.S.C. 154(b) by 216 days.

(21) Appl. No.: 11/446,278

(22) Filed: Jun. 2, 2006

(51) Int. Cl.
*E05B 73/00* (2006.01)

(52) U.S. Cl. ..... 70/63; 42/70.11; 109/47; 206/317; 312/311

(58) Field of Classification Search ..... 70/63; 224/912; 206/317, 751, 754, 755; 312/311, 312/310; 109/45, 47; 42/70.01, 70.11, 70.06, 42/70.07, 70.09; 211/4, 64; 248/286.1, 299.1, 248/551–553; 220/262, 263
See application file for complete search history.

(56) References Cited

U.S. PATENT DOCUMENTS 1,227,813 A * 5/1917 Mahoney ..... 312/274
1,417,814 A * 5/1922 Fairweather ..... 190/16
1,430,081 A * 9/1922 Holler ..... 224/281
1,557,339 A * 10/1925 Sander ..... 224/542
2,637,614 A * 5/1953 Simos ..... 312/272.5
3,464,606 A * 9/1969 Nordeen ..... 224/281
3,658,050 A * 4/1972 Snyder ..... 126/340
4,309,065 A * 1/1982 Pappas ..... 312/242
4,800,822 A * 1/1989 Adkins ..... 109/19
5,056,342 A * 10/1991 Prinz ..... 70/63
5,118,175 A * 6/1992 Costello ..... 312/242
5,168,994 A * 12/1992 Beletsky et al. ..... 206/317
5,544,595 A * 8/1996 Stephenson et al. ..... 109/74
6,405,861 B1 * 6/2002 Siler et al. ..... 206/317
6,570,501 B2 * 5/2003 Bushnell et al. ..... 340/542
6,843,081 B1 * 1/2005 Painter ..... 70/63
6,918,519 B2 7/2005 Vor Keller et al.
7,159,711 B1 * 1/2007 Gardner ..... 206/317
7,325,682 B2 * 2/2008 Seymour et al. ..... 206/379

* cited by examiner

*Primary Examiner*—Lloyd A Gall
(74) *Attorney, Agent, or Firm*—Palomar Patent; Calif Tervo

(57) ABSTRACT

A vault for a weapon having a handle generally comprises a lock box defining a cavity having a front opening, a door hingly attached to the box, a slider assembly including a slider and a holster mounted to the slider adapted for holstering a weapon with the handle forward, wall guides guiding the slider in the box for sliding reciprocating movement in the front to rear direction, and links linking the door and the slider such that moving the door between the closed position and the open position moves the slider from the storage position wherein the weapon in the holster is within the cavity to the deployed position wherein the handle of a weapon in the holster protrudes from the opening for gripping by a user.

7 Claims, 2 Drawing Sheets

GUN VAULT WITH POP-UP HOLSTER

FIELD OF THE INVENTION

This invention relates in general to vaults or lock boxes, and more specifically to a pistol vault with a holster that pops up when the door is opened so as to present the pistol handle to the user.

SUMMARY OF THE INVENTION

A vault for a weapon having a handle generally comprises a box defining a front opening to a cavity, a door hingly attached to the box and movable between a closed position covering the opening to the cavity and an open position, a slider assembly including a slider and a holster mounted to the slider adapted for holstering a weapon with the handle forward, wall guides guiding the slider in the box for sliding reciprocating movement in the front to rear direction of the slider in the cavity between a storage position and a deployed position, and links linking the door and the slider such that moving the door between the closed position and the open position moves the slider from the storage position wherein the weapon in the holster is within the cavity to the deployed position wherein the handle of a weapon in the holster protrudes from the opening for gripping by a user.

In an exemplary embodiment, the links comprise a door arm fixed to the door and protruding therefrom and a linking arm including an outer end pivotly connected to the door arm and an inner end pivotly connected to the slider assembly. The slider includes sliding guides and the wall guides include opposed, parallel longitudinal tracks in the top and bottom walls adapted for cooperating with the slider guides. A door hinge, including a hinge pin having ends, is on the outside of the box and is covered by the door in the closed position.

A combination includes a weapon having a handle and a holster holstering the weapon such that the handle is accessible disposed in a vault having a hinged door such that opening the door pops up the holster and weapon such that the handle protrudes from the vault.

Other features and many attendant advantages of the invention will become more apparent upon a reading of the following detailed description together with the drawings wherein like reference numerals refer to like parts throughout.

DETAILED DESCRIPTION OF THE INVENTION

Figure 1:
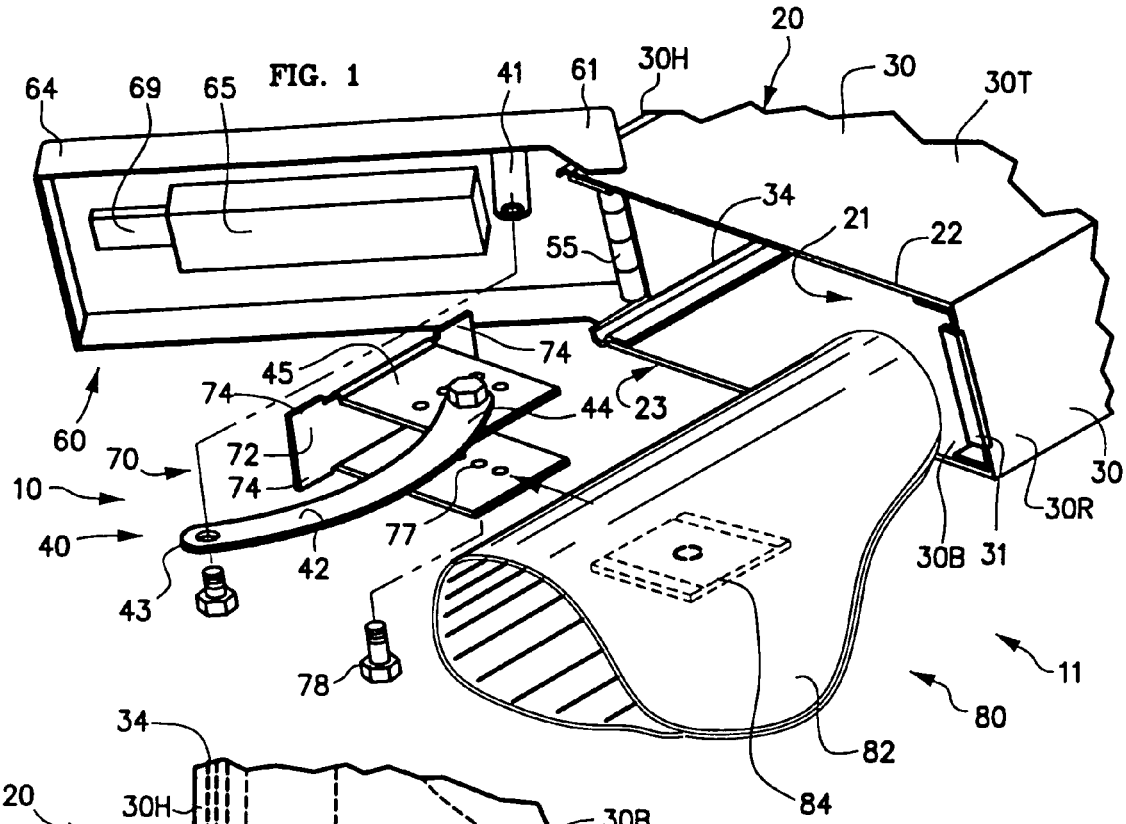
FIG. 1 is an exploded front, top, right side perspective view of the front end of an exemplary embodiment of the gun vault with pop-up holster.

With reference now to the drawings, there is shown in FIG. 1 an exploded front, top, right side perspective view of the front end 11 of an exemplary embodiment of the weapon vault 10 including a pop-up holster 82. Vault 10 generally includes a box 20 having a front end 22 defining a front opening 23 to a cavity 21, a door 60 attached by hinge 55 to box 20 for covering front opening 22, and a slider assembly 70 including a slider 72 and holster 82.

Figure 4:
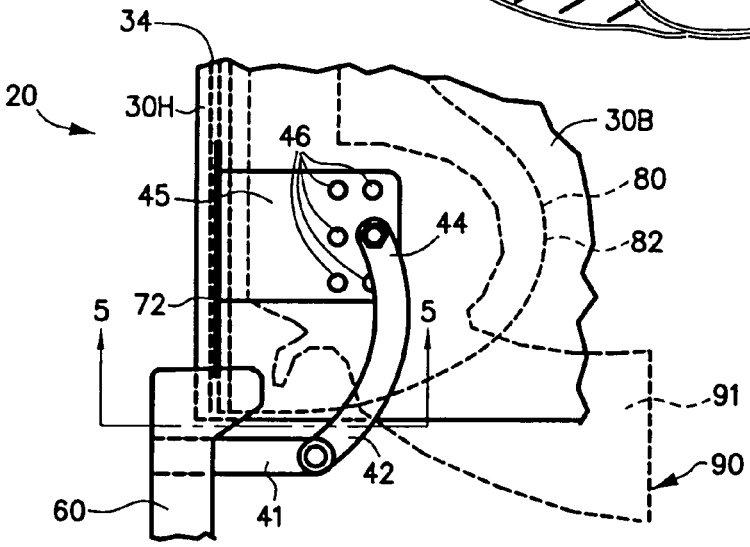
FIG. 4 is a partial top plan view of the hinge area of vault with the door in the ninety degree open position.
Figure 5:
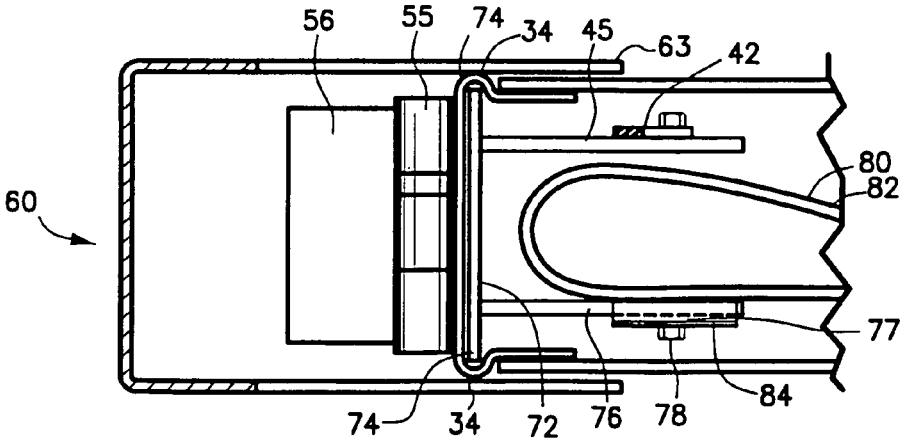
FIG. 5 is a partial sectional view of the door, hinge, slider and slider track taken on line 5-5 of FIG. 4.
Figures 2, 3:
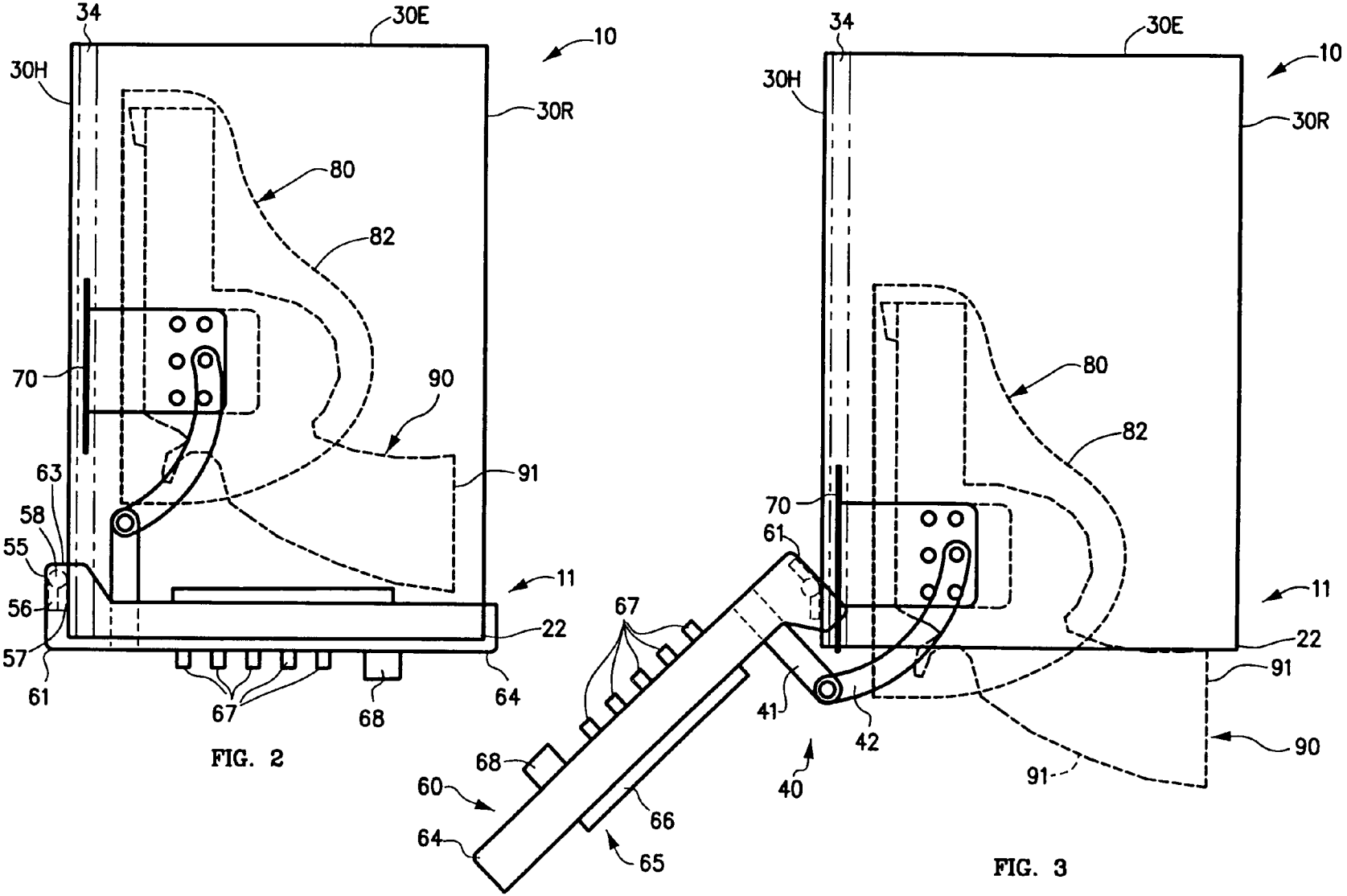
FIG. 2 is a diagrammatic top plan view of the embodiment of FIG. 1 with the door closed and further showing a pistol in phantom.
FIG. 3 is a diagrammatic top plan view of the embodiment of FIG. 2 with the door fully open.

FIG. 2 is a diagrammatic top plan view of the embodiment of FIG. 1 with door 60 closed and further showing a pistol, such as an automatic pistol or a revolver 90, in phantom. FIG. 3 is a diagrammatic top plan view of the embodiment of FIG. 2 with door 60 fully open. FIG. 4 is a partial top plan view of the hinge 55 area of vault 10 with door 60 in the ninety degree open position. FIG. 5 is a partial sectional view of door 60, hinge 55, slider 72, and slider track 34 taken on line 5-5 of FIG. 4.

Box 20 includes walls 30 including end wall 30E, top wall 30T, bottom wall 30B, right side wall 30R, and left side wall or hinge wall 30H. Front opening 23 in front end 22 of box 20 allows access to cavity 21. The front to end direction defines the longitudinal direction. As is well-known in the art, box 20 is typically made of strong planar panels, such as of sheet steel. Walls 30 are joined together, such as by welding, so as to provide a secure enclosure.

Box 20 and slider assembly 70 include cooperative guide means for guiding slider 72 in box 20 for sliding reciprocating movement of slider 72 in cavity 21 between a storage position and a deployed position. In the exemplary embodiment, the cooperative guide means of box 20 includes opposed, parallel longitudinal tracks, such as channels 34 in top and bottom walls 30T, 30B adapted for cooperating with cooperative guiding means of slider 72. Channels 34 may be formed with a double bend in the metal sheet. This is best seen in FIGS. 4 and 5.

Door 60 includes a hinged end 61 and a free end 64. Hinged end 61 is hingly attached to box 20 with hinge means, such as a hinge, such as a piano hinge 55 having a first leaf 56 attached to inside of door 60 and a second leaf 57 attached to hinge side wall 30H. In the exemplary embodiment, the axis of hinge 55 is on the outside of hinge wall 30H for reasons as will be further explained. Door 60 is movable between a closed position covering front opening 23 of box 20, as shown in FIG. 2, and an open position, shown in FIG. 3, allowing access to cavity 21. As best seen in FIG. 2, door 60 is adapted, such as with a hinge cover, such as extension 63, to cover an end or the ends of hinge 55 when door 60 is in the closed position. Thus, in the closed position, door 60 protects the end of hinge pin 58 of hinge 50 from attack by a would-be thief.

Vault 10 is provided with locking means 65 for locking door 60 in the closed position. Any of many suitable locking means, as are well-known in the art, may be used. In the exemplary embodiment, door 60 includes a push button lock 66 including push buttons 67, a latch bolt activation knob 68, and a latch bolt 69 for interaction with bolt cooperating means, such as latch catch 31, a flange attached to right side wall 30R.

Slider assembly 70 generally includes a slider 72 and holstering means 80, such as gun holster 82, for holding a weapon, such as a pistol, such as revolver 90. Slider 72 includes cooperative guiding means, such as track engagement means, such as guide tabs 74, for insertion in channels 34 for engaging channels 34 for guiding sliding of slider 72 in the longitudinal direction. Preferably, channels 34 are adjacent hinge side wall 30H such that slider 72 slides along hinge side wall 30H. This adds stability and lowers friction to slider 72. However, this requires hinge 55 to be disposed outside of box 20 so as not to block slider 72. Although the cooperative guide means for guiding slider 72 in box 20 is shown as channels 34 in box 20 and guide tab(s) 74 on slider 72, other means are contemplated. For example, the channel and guide tab(s) may be on the other element or may be in the form of a slide mechanism similar to that on a drawer. However, the channel 34 and guide tabs 74 of the exemplary embodiment provide very simple guiding means without additional elements.

Pistol 90 has a handle 91 for gripping by a user. Pistol holster 82 is adapted to hold a pistol 90 with handle 91 toward front end 11 of box 20. Holster 82 may be of conventional style as is well-known in that art for holding a pistol and includes attachment means, such as belt loop 84, for attaching holster 82 on a belt of a user. Slider 72 is adapted for easily mounting holster 82. Slider 72 includes a horizontal bracket 76 that, in effect, emulates a belt, for receiving belt loop 84 of holster 82. In this manner, pistol 90 in its conventional belt holster 82 can be easily attached to slider 72. Holster securing means, such as screw 78 is screwed through holster 82, such as through belt loop 84, and into securing bore 77 on holster bracket 76, is provided for securing holster 82 on holster bracket 76.

Linking means 40 is provided for linking door 60 and slider assembly 70 such that moving door 60 between the closed position, shown in FIG. 2, and the open position, shown in FIG. 3, moves slider 72 from the storage position, shown in FIG. 2, wherein pistol 90 in holster 82 is inaccessible, to the deployed position, shown in FIG. 3, wherein handle 91 of pistol 90 protrudes from front opening 23 of box 20 for gripping by a user. In the exemplary embodiment, linking means 40 comprises a door arm 41 fixed to door 60 and protruding therefrom and a linking arm 42 including an outer end 43 pivotly connected to the outer end of door arm 41 and an inner end 44 pivotly connected to slider assembly 70, such as to link bracket 45. In the exemplary embodiment, door arm 41 is rigid and attached door 60 at a right angle. Link bracket 45, connected to slider 72, includes means, such as a slot or slots or a plurality of attachment bores 46, for adjusting the position of slider 72 relative to link arm 42 so as to adjust the deployed position of pistol 90 and handle 91. For example, for smaller pistols a rear-most bore 46 might be used.

From the foregoing description, it can be appreciated that the vault provides a simple and efficient manner of providing safe storage for a weapon and yet provides for the rapid accessibility of the weapon be a user in time of need.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. In combination:

a weapon having a handle;

a holster holstering said weapon such that said handle is accessible; said holster including:

a belt loop for mounting said holster on a belt of a user; and a vault comprising:

a box defining a cavity having a front opening; front to back defining the longitudinal direction; said box including:

walls; including:

a top wall;

a bottom wall; and a hinge side wall therebetween;

a door attached by a hinge to said hinge side wall and movable between a closed position covering said front opening and an open position;

a slider assembly including:

a slider; and a horizontal bracket connected to said slider and inserted into said belt loop of said holster such that said holster is mounted on said slider assembly such that said handle of said weapon is forward;

guiding means guiding said slider in said box for sliding reciprocating movement in the longitudinal direction of said slider in said cavity between a storage position and a deployed position; and linking means linking said door and said slider such that moving said door between the closed position and the open position moves said slider from the storage position, wherein the weapon is within said cavity, forward to the deployed position, wherein said handle of said weapon protrudes from said front opening.

2. The combination of claim 1 wherein:

said linking means comprises:

a door arm fixed to said door and protruding therefrom; and a linking arm including:

an outer end pivotly connected to said door arm; and an inner end pivotly connected to said slider assembly.

3. The combination of claim 2 wherein:

said door arm is rigid.

4. The combination of claim 2 wherein:

said linking arm is rigid.

5. The combination of claim 4 wherein:

said door arm is rigid.

6. The combination of claim 1 wherein:

said slider includes:

cooperative guiding means for cooperating with said guiding means of said box for guiding sliding;

said guiding means of said box includes:

a single pair of opposed, parallel longitudinal tracks on or proximal said hinge side wall including:

a downward facing track; and an upward facing track; adapted for cooperating with said cooperative guiding means of said slider for guiding said slider in said cavity in said box for sliding reciprocating movement in the longitudinal direction of said slider in said cavity; and said horizontal bracket is cantilevered from said slider and projects away from said hinge side wall.

7. The combination of claim 6 further including:

said hinge having a hinge pin outside said cavity; said hinge pin having a longitudinal axis and ends; said hinge connecting said door to said hinge side wall; and wherein:

said door is adapted to cover at least one said end of said hinge pin when said door is in the closed position so as to prevent a longitudinal force from being applied to said end of said hinge pin.

* * * * *